US005146868A

United States Patent [19]

Kirk

[11] Patent Number: 5,146,868

[45] Date of Patent: Sep. 15, 1992

[54] SELF CONTAINED RECIRCULATING POWDERING A VACUUMING ASSEMBLY

[76] Inventor: Cecil K. Kirk, 6605 21st St. East, Sarasota, Fla. 34243

[21] Appl. No.: 601,994

[22] Filed: Oct. 23, 1990

[51] Int. Cl.[5] ..... B05B 7/14

[52] U.S. Cl. ..... 118/713; 15/345; 15/346; 15/422; 118/46; 118/50; 118/56; 118/63; 118/309; 118/312; 118/324; 118/326; 118/DIG. 7

[58] Field of Search ..... 118/713, 46, 50, 50.1, 118/56, 63, 64, 308, 309, 312, 324, 326, DIG. 7; 15/306 R, 306 B, 312 R, 345, 346, 415 R, 419, 422

[56] References Cited

U.S. PATENT DOCUMENTS

| | | | |
|---|---|---|---|
| 2,916,761 | 12/1959 | Öberg | 15/346 |
| 3,793,986 | 2/1974 | Latone | 118/312 |
| 3,918,399 | 11/1975 | Fox et al. | 118/312 |
| 4,111,154 | 9/1978 | Kissel et al. | 118/312 |
| 4,414,913 | 11/1983 | Sarda | 118/312 |
| 4,457,043 | 7/1984 | Oeberg | 15/346 |
| 4,514,779 | 4/1985 | Wilkinson | 118/312 |
| 4,570,287 | 2/1986 | Kerschner et al. | 15/346 |
| 4,811,688 | 3/1989 | Turner | 118/46 |

*Primary Examiner*—Jay H. Woo
*Assistant Examiner*—Robert B. Davis
*Attorney, Agent, or Firm*—Charles J. Prescott

[57] ABSTRACT

A self contained recirculating powdering and vacuuming assembly and the airflow discharge manifold therfor. The vacuum assembly includes a blower operably connected within a housing having a low and high pressure region. A powder tray is mounted beneath a first outlet at the bottom of the low pressure region and is structured to hold a quantity of powder for controlled depositing onto paper stock having a wet ink coating on preselected areas of the paper stock. This first outlet sealably transfers powder collected in the low pressure region back into the powder tray, which powder is transported by conveyor beneath the powder tray. A vacuum passage extends downward from a low pressure region inlet to a powder pickup slot positioned adjacent to the area where the powder is deposited onto the paper stock. Pressurized air is directed toward the pickup slot from either side thereof by the airflow discharge manifold which receives air from the high pressure region outlet. By being in very close proximity above the conveyor, very little air or loose powder fails to be drawn up throug the powder pickup slot for recirculation through the assembly.

7 Claims, 3 Drawing Sheets

SELF CONTAINED RECIRCULATING POWDERING A VACUUMING ASSEMBLY

BACKGROUND OF THE INVENTION

This invention is generally directed to thermographic machines for relief printing, and more particularly to a self contained recirculating powder and vacuuming assembly contained therein.

Presently, one element of a thermographic machine for relief printing is utilized to both deposit the thermographic powder atop paper stock which has been wet inked and is made to pass below a powder discharge tray by conveyor. Adjacent the powder discharge tray is a vacuum actuated powder pickup slot which removes loose, unadhered powder from atop the paper stock before it is passed on for heat fusion of the adhered powder.

The housing containing a blower and the powder tray typically is structured so as to discharge the powder and air out through an outlet into either atmosphere or into a collecting bag. This process results in an unacceptable discharge of the fine thermographic powder into the atmosphere.

One such thermographic machine is generally shown in U.S. Pat. No. 4,805,531 to Sarda which is particularly directed to a unique arrangement for cutting and manipulating paper stock. An anti-pollution grain dryer which includes a system for recycling air suction from the bin through an external cyclone dust separator back into a plenum chamber for reuse is disclosed in U.S. Pat. No. 4,241,517 to Carpenter.

The present system provides for a self contained recirculating powdering and vacuuming assembly which removes the loose powder from the inked paper stock more efficiently by the application of directed air toward the pickup slot from either side thereof and then recollects the loose powder and redeposits it into the powder tray for reuse. Thus, no powder ever exits the assembly but rather continues to be recycled therewithin until fully used or replenished.

BRIEF SUMMARY OF THE INVENTION

This invention is directed to a self contained recirculating powdering and vacuuming assembly and the airflow discharge manifold therefore. The vacuum assembly includes a blower operably connected within a housing having a low and high pressure region. A powder tray is mounted beneath a first outlet at the bottom of the low pressure region and is structured to hold a quantity of powder for controlled depositing onto paper stock having a wet ink coating on preselected areas of the paper stock. This first outlet sealably transfers powder collected in the low pressure region back into the powder tray which is transported by conveyor beneath the powder tray. A vacuum passage extends downward from a low pressure region inlet to a powder pickup slot positioned adjacent to the area where the powder is deposited onto the paper stock. Pressurized air is directed toward the pickup slot from either side thereof by the airflow discharge manifold which receives air from the high pressure region outlet. By being in very close proximity above the conveyor, very little air or loose powder fails to be drawn up through the powder pickup slot for recirculation through the assembly.

It is therefore an object of this invention to provide a recirculating powdering and vacuuming assembly of a thermographic relief printing machine which prevents discharge of loose thermographic powder into the atmosphere.

It is another object of this invention to fully utilize thermographic powder in a thermographic relief printing machine by recirculation without wasting any of the powder.

It is yet another object of this invention to provide a unique air discharge manifold for both directing pressurized air against the powdered paper stock and for more efficiently vacuuming the loose powder therefrom as the paper stock passes therebelow by conveyor.

In accordance with these and other objects which will become apparent hereinafter, the instant invention will now be described with reference to the accompanying drawings

DETAILED DESCRIPTION OF THE INVENTION

Figure 2:
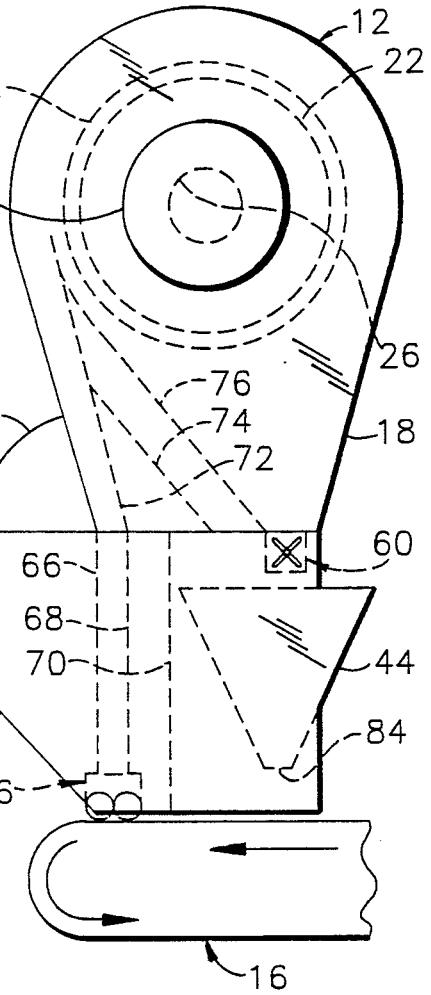
FIG. 2 is a schematic view in the direction of arrows 2—2 in FIG. 1.
Figure 1:
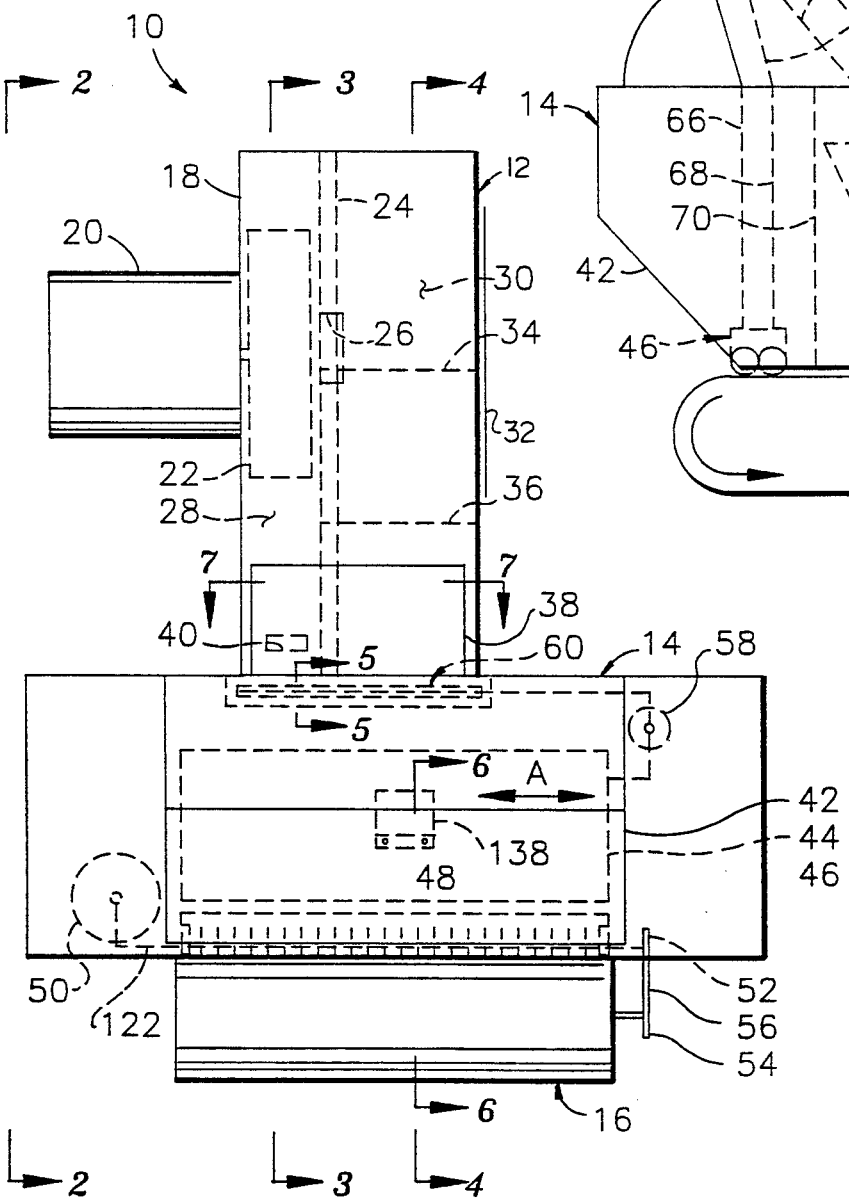
FIG. 1 is a schematic side elevation view of the paper discharge end of the present invention.

Referring now to the drawings, and firstly to schematic FIGS. 1 and 2, the preferred embodiment of the invention is shown at numeral 10 and generally includes an upper housing assembly 12 and a lower housing assembly 14. The lower housing assembly 14 is positioned a conveyor 16 for conveying paper stock in the direction of the arrow shown in FIG. 2.

The upper housing assembly 12 includes a blower motor 20 which is operably connected to a squirrel cage impeller 22 mounted within an upper housing 18. An upright baffle 24 is connected within the upper housing 18 and is positioned so as to form a high pressure region 28 on one side of baffle 24 and a low pressure region 30 on the other side thereof. A low pressure region outlet 26 is formed through the baffle 24 generally coaxial with the central portion of the squirrel cage impeller 22 so that air may be drawn by impeller 22 from the low pressure region 30 into the high pressure region 28.

Figure 3:
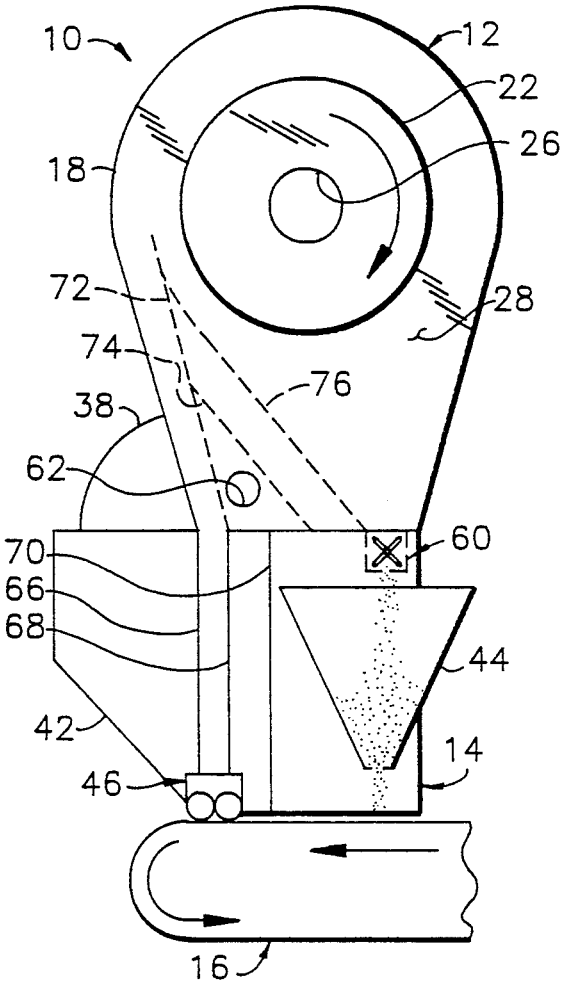
FIG. 3 is a schematic section view in the direction of arrows 3—3 in FIG. 1.
Figure 4:
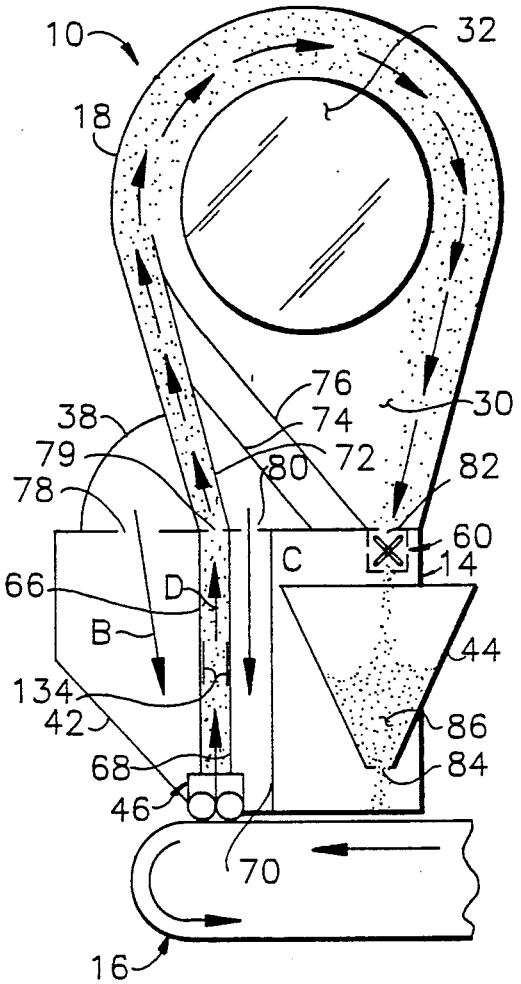
FIG. 4 is a schematic section view in the direction of arrows 4—4 in FIG. 1.

Referring additionally to FIGS. 3 and 4, the upper housing 18 includes transverse panels 72, 74 and 76 which are connected across the low pressure region side of baffle 24. The relationship and airflow/powder flow function of these panels 72, 74 and 76 to the entire assembly 10 will be described herebelow.

Also shown in FIG. 4 is a transparent inspection plate 32 which is detachable from upper housing 12 and provides for observation of thermographic powder (commonly known as polyamide resin) used in the thermographic relief printing process.

The lower housing assembly 14 includes an elongated powder tray 44 which will hold a quantity of powder 86. The upper portion of powder tray 44 is open so as to receive powder collected from sealed powder transfer member 60 as will be herebelow described and to be otherwise refilled. The lower, narrowed portion of powder tray 44 includes a metering opening 84 for depositing powder atop paper stock which includes wet ink portions which adheres to the loose powder 86.

Figure 5:
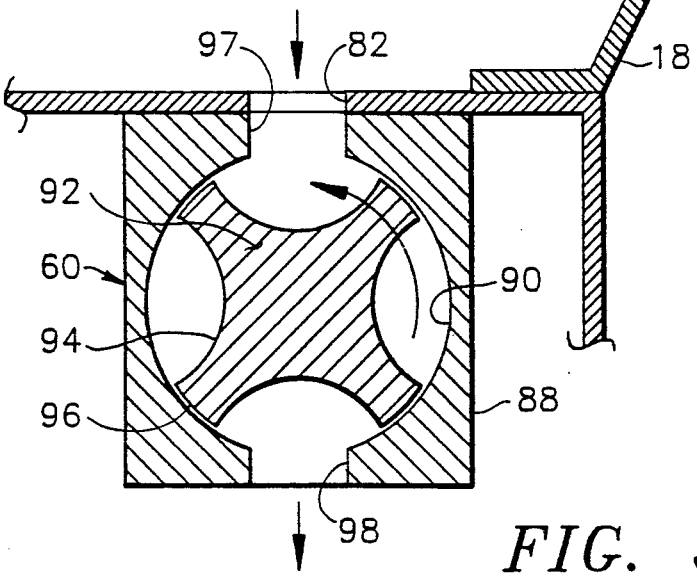
FIG. 5 is a section view in the direction of arrows 5—5 in FIG. 1.
Figure 7:
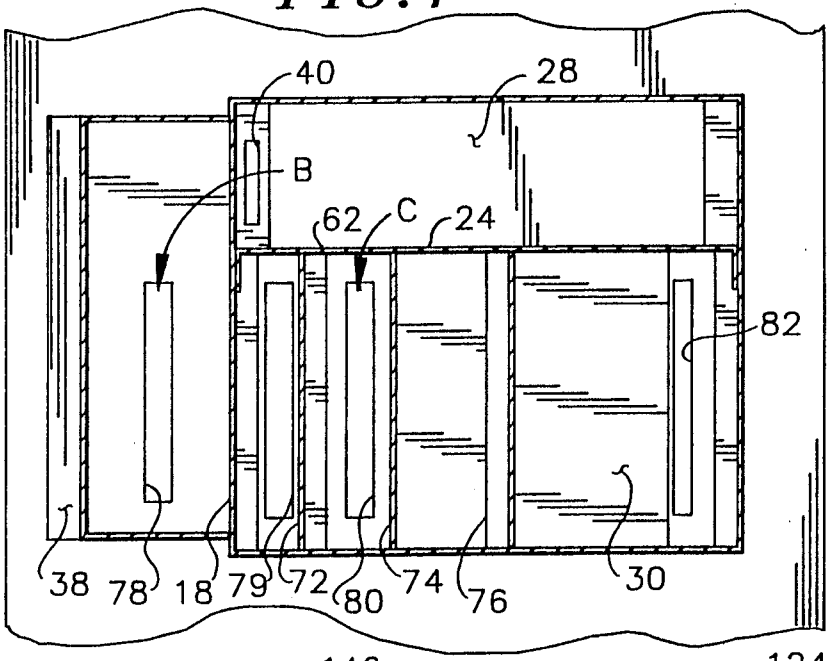
FIG. 7 is an enlarged section view in the direction of arrows 7—7 in FIG. 1.
Figure 6:
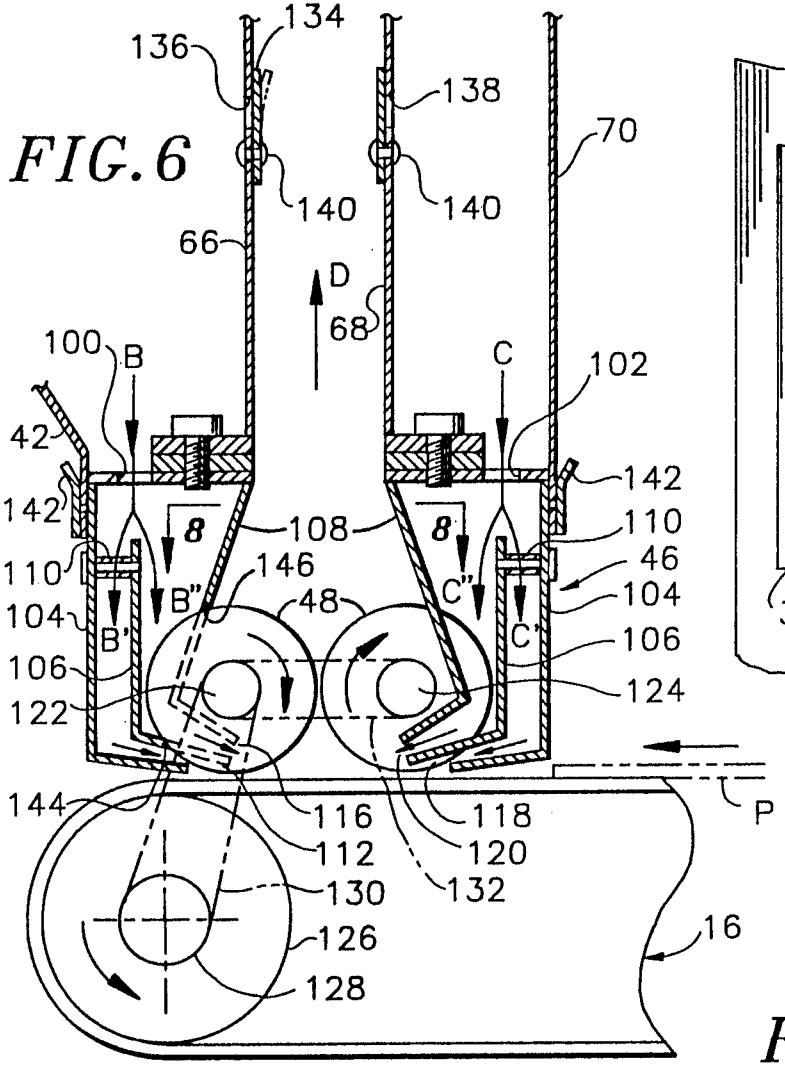
FIG. 6 is an enlarged section view in the direction of arrows 6—6 in FIG. 1.

Referring additionally to FIGS. 5, 6 and 7, adjacent the powder tray 44 within lower housing 14 are a series of additional transverse baffles 66, 68 and 70 which are positioned in spaced upright orientation as best seen in FIGS. 2, 3, 4 and 6. These panels 66, 68 and 70, coupled with a powder pick up assembly 46, form an airflow discharge manifold which receives pressurized air from within high pressure region 28 by impeller 22 through apertures 40, then aperture 78, in the direction of arrow B and through aperture 62, then aperture 80, in the direction of arrow C. Discharge of this pressurized air is through air nozzles formed in powder pick up assembly 46 which will be described herebelow.

A vacuum or low pressure passageway is also formed within the airflow discharge manifold between baffles 66 and 68 and extends at its lower end from the powder pick up assembly 46 up through lower housing 14 to aperture 79 and then between the outer surface of upper housing 18 and panel 72 so that the reduced pressure created within low pressure region 30 draws both air and loose powder upward from atop the paper stock through the central portion of air discharge assembly 46 upward in the direction of arrow D and around upper housing 18 in the direction of the arrows seen in FIG. 4.

The loose powder moving in the direction of the arrows in FIG. 4 circulates within the low pressure region 30 and then is deposited at an elongated outlet aperture 82 as also seen in FIG. 7. Panel 76 cooperates with the inwardly tapering outer wall of upper housing 18 so as to direct by gravity the loose powder down to outlet 82. Air is then drawn in the direction of the arrow in FIG. 1 through outlet 26 back into the high pressure region 28 by impeller 22.

The system 10 is thus intended to deposit powder onto inked paper stock and to vacuum or collect the loose remaining unattached powder from each paper stock sheet on an ongoing basis as paper stock is transferred beneath the device 10 on conveyor 16 on a continuous basis. As previously described, the loose vacuumed powder is drawn upward between the vacuum passageway formed by panels 66 and 68, through aperture 79 around the upper housing 18, and then deposited atop outlet aperture 82.

To insure that the loose powder is not discharged into the atmosphere, but nonetheless is redeposited into powder tray 44, a sealed powder transfer member 60, as best seen in cross section in FIG. 5, is also provided. This powder transfer member 60 includes an elongated hollow housing 88 having a cylindrical interior surface 90 which includes an upper slot 97 in alignment with outlet aperture 82 and a lower discharge slot 98 which is positioned above powder tray 44. A central rotatable transfer bar 92 is provided having a plurality of contoured longitudinal cavities 94 spaced between sealing edges 96 which sealably mate against cylindrical interior surface 90. By this arrangement, as transfer bar 92 is rotated in the direction of the arrows, powder entering into each cavity 94 through outlet 82 is moved circumferentially in the direction of the arrow and then discharged through opening 98 downward in the direction of the arrows into powder tray 44. No air escapes therefrom.

Another important aspect of this invention is the dislodgement of loose powder from atop the paper stock P upwardly in the direction of arrow D shown in FIG. 6 and in a fashion which does not disperse loose powder into the atmosphere. To accomplish this, the powder pick up assembly 46 shown in FIG. 6 is provided.

The powder pick up assembly 46 as seen in FIG. 1 is generally the same width as the conveyor 16 and/or the paper stock P. This assembly 46, connected to panels 42, 66, 68 and 70 of lower housing 14, includes a pair of opposing formed inner panels 108, formed opposing outer panels 104, and intermediate formed panels 106 as shown. Note that intermediate panels 106 are optional.

Elongated slots 100 and 102 allow pressurized downward airflow in the direction of arrows B and C, supplied as previously described. This airflow in the direction of arrows B and C is divided by intermediate panels 106 which are held in place by spacers 110 so that a portion of the airflow B' and C' flows and is directed toward the central portion of powder collection assembly 46 through outlet nozzles 112 and 118. The remaining portion of airflow at B" and C" is directed toward the center of powder collection assembly 46 through outlet nozzles 116 and 120.

As this pressurized airflow discharges from either direction toward the center of the powder pick up assembly 46 and slightly downwardly against the paper stock, the loose powder is lifted and blown from the paper. The vacuum or reduced pressure between panels 66 and 68 which is in fluid communication with the low pressure region 30 causes the air and loosened powder to all flow upwardly in the direction of arrow D.

To insure that loose powder or air does not escape into the atmosphere, the outer formed panels 104 are positioned at their lower distal margins in very close proximity (approximately one sixteenth of an inch above the conveyor 16. The width of each transverse air discharge nozzle 112, 116, 118 and 120 is approximately one eighth of an inch. It is preferred that approximately eighty percent of the airflow occurs in the direction of arrows B' and C', while the remaining twenty percent of the airflow is in the direction of the arrows B" and C".

Figure 8:
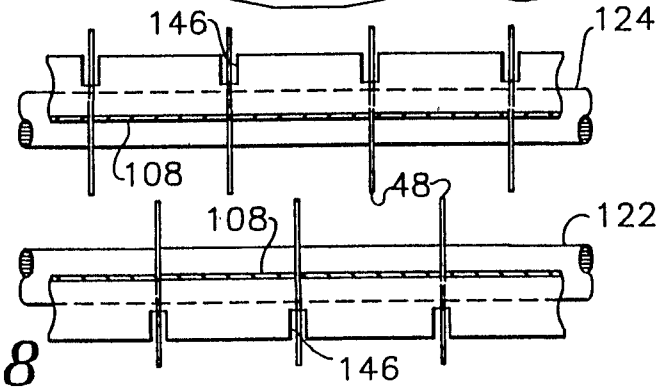
FIG. 8 is a partial section view in the direction of arrows 8—8 in FIG. 6.

Referring additionally to FIG. 8, because of the turbulence caused by the opposing airflow from outlet nozzles 112 and 116 against nozzles 118 and 120, the paper stock P has a tendency to lift from the conveyor 16. To assist in smoothly transferring the powdered paper stock P along beneath the powder pick up assembly 46 without leaving marks on the paper stock from inked powder, two rows of spaced thin upright discs 48 are drivably mounted on rotatable elongated shafts 122 and 124 as best seen in FIG. 8. These thin discs 48 are evenly spaced on each shaft 122 and 124 and are in staggered opposing orientation one row to another as shown. These discs 48 are held on shafts 122 and 124 in very close proximity above the conveyor 16 so as to drivably contact against the paper stock P as it is translated therebelow. Slots 146 and 144 are provided in inner panel 108 and intermediate panel 106, respectively to accommodate the discs 48 therebetween. The edges of rollers 48 are preferably quite sharp so as to eliminate the possibility of tracking wetted powder as the paper stock P is driven beneath the powder pick-up assembly 46.

As seen in FIG. 1, a motor 50 is operably connected to shaft 122 which, in turn, is chain drive connected at 132 to drive shaft 124 and is also connected by chain drive 130 so as to drive shaft 128 of conveyor 116 all in unison.

Motor 58 is operably connected to rotate powder transfer bar 92 as previously described in FIG. 5 and also to slightly vibrate powder tray 44 back and forth in the direction of arrow A so as to maintain an even level of powder 86 within powder tray 44.

Should powder pick up assembly 46 become clogged in any way or should an inordinate pressure imbalance occur between the pressurized regions and the vacuum regions of the lower housing 14, reed or flapper valves 134 as best seen in FIGS. 1, 4 and 6 are provided. These reed valves 134 are connected by rivets 140 to panels 66 and 68 as shown. When the pressure differential reaches a preselected level, these reed valves 134 open in the direction shown in phantom so as to allow pressurized air to flow through otherwise sealed apertures 136 and 138 into the region between panels 66 and 68. As soon as the pressure differential is reduced, reed valves 134 automatically close, resealing apertures 136 and 138.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A self contained recirculating powdering and vacuuming assembly of a thermographic relief printing system comprising:

a blower operably connected within a housing creating a low pressure region and a high pressure region within said housing;

a powder tray beneath a first outlet of said low pressure region, said powder tray structured to hold a quantity of powder and to controllably deposit powder onto a paper stock therebelow having a wet ink coating on preselected areas of the paper stock;

a vacuum passage extending between an inlet of said low pressure region and an elongated powder pick-up slot just above and transverse to a conveyor for transforming the paper stock;

a pressurized airflow manifold extending between an outlet of said high pressure region and a first elongated air discharge nozzle on each upstream side and downstream side of, and generally coextensive with, said powder pick-up slot;

each said first discharge nozzle positioned immediately above and in very close proximity to the conveyor and directed toward said powder pick-up slot;

a lower margin of each said first discharge nozzle structured to sealably act with the paper stock to confine substantially all pressurized air exiting from said first discharge nozzle therebetween to loosen unadhered powder from atop the paper stock for suction transfer into said vacuum passage;

said lower pressure region structured to continuously separate air and powder drawn into said low pressure region through said low pressure region inlet, to deposit the powder at said low pressure region first outlet, return the air into a second outlet of said low pressure region into said high pressure region, then into said pressurized airflow manifold;

a sealed means connected beneath said low pressure region first outlet for transferring powder accumulated at said low pressure region first outlet into said powder tray.

2. A self contained recirculating powdering and vacuuming assembly as set forth in claim 1, further comprising:

two spaced apart parallel rows of alternately aligned upright spaced discs, each said row of discs generally coextensive with, and positioned between, said first nozzles, each said row of discs drivably mounted on a rotatable shaft;

said discs positioned in very close proximity above the conveyor whereby the paper stock is held against the conveyor as the paper stock passes beneath said discs.

3. A self contained recirculating powdering and vacuuming assembly as set forth in claim 1, further comprising:

an intermediate formed panel connected and positioned within each said first nozzle to form a second elongated air discharge nozzle coextensive and generally aligned with, and immediately above, said first nozzle whereby pressurized air entering said manifold is divided between each said first and second nozzles in preselected proportion.

4. A self contained powdering and vacuuming assembly as set forth in claim 3, further comprising:

vacuum valve means connected at an intermediate point between said vacuum passage and said airflow manifold for permitting airflow directly from said airflow manifold into said vacuum passage at a predetermined differential of air pressure therebetween.

5. A self contained powdering and vacuuming assembly as set forth in claim 4, further comprising:

a vibrator connected to said powder tray for evenly dispersing powder in said powder tray.

6. A self contained powdering and vacuuming assembly as set forth in claim 5, further comprising:

a transparent inspection panel connected to said housing positioned to permit viewing of powder in said low pressure region.

7. A self contained powdering and vacuuming assembly as set forth in claim 1, wherein:

said housing includes a central upright baffle having said low pressure region second outlet therethrough and forming said low and high pressure regions on either side of said baffle.

* * * * *